US005338228A

United States Patent [19]

Wright, Jr. et al.

[11] Patent Number: 5,338,228

[45] Date of Patent: Aug. 16, 1994

[54] FUSE HOLDER

[75] Inventors: Austin J. Wright, Jr., Aurora; Joseph P. Pecukonis, Englewood, both of Colo.

[73] Assignee: Amprobe Instrument, Lynbrook, N.Y.

[21] Appl. No.: 135,027

[22] Filed: Oct. 12, 1993

[51] Int. Cl.[5] ..... H01R 13/68

[52] U.S. Cl. ..... 439/621; 337/213

[58] Field of Search ..... 439/621, 622; 337/187, 337/188, 201, 213, 214, 196, 212

[56] References Cited

U.S. PATENT DOCUMENTS

| | | | |
|---|---|---|---|
| 3,699,500 | 10/1972 | Borzoni et al. | 439/622 |
| 4,126,368 | 11/1978 | Godfrey et al. | 439/621 |
| 4,543,557 | 9/1985 | Schaefer | 439/621 |
| 4,938,715 | 7/1990 | Jones et al. | 439/621 |
| 5,150,094 | 9/1992 | Babini | 439/621 |
| 5,221,217 | 6/1993 | Oikawa | 439/621 |
| 5,240,435 | 8/1983 | Forbrook | 439/621 |

*Primary Examiner*—Gary F. Paumen

*Attorney, Agent, or Firm*—John R. Ley; John B. Phillips

[57] ABSTRACT

A fuse holder retains and removably connects a fuse to fuse clips within an electrical device. The fuse holder includes a fuse drawer having an open top to hold the fuse. Openings in the fuse drawer are adapted to receive the fuse clips. A guide within the electrical device facilitates sliding the fuse drawer between an open position outside of the electrical device and a closed position within the device. In the closed position, the fuse clips extend through the openings in the fuse drawer and engage the fuse within the fuse drawer to close the electrical circuit within the electrical device. An individual is unable to contact the fuse when the fuse drawer is closed within the electrical device. Similarly, the fuse is disengaged from the fuse clips and the electrical circuit is broken when the fuse drawer is opened so that it is not possible for an individual to contact the fuse while the fuse is connected to the electrical circuit.

15 Claims, 3 Drawing Sheets

FUSE HOLDER

FIELD OF THE INVENTION

This invention relates to fuses and fuse holders. More particularly, the present invention relates to an apparatus and technique for safely mounting, retaining and removing cartridge fuses in an electrical device.

BACKGROUND OF THE INVENTION

Fuses used in electrical devices are often subjected to high levels of current and/or voltage and often reach momentary high temperatures when placed within an electrical circuit. Since fuses typically require routine inspection and periodic replacement, they are frequently placed on the exterior of electrical devices for ease of access. However, such placement increases the chances that an individual may accidentally contact the fuse during operation of the electrical device. Furthermore, external placement of the fuse may lead an individual to erroneously conclude that it is safe to contact the fuse while the electrical circuit is energized. Whether accidental or intentional, contact with a fuse that is connected to an energized circuit can cause an individual to suffer a burn or an electrical shock.

Many manufacturers of electrical devices have attempted to reduce the potential for injury resulting from contact with a fuse. Indeed, certification agencies such as Underwriters Laboratory and the California Safety Association frequently rate electrical devices according to the potential for an individual to contact a fuse while it is connected to the energized circuit.

Some manufacturers have attempted to solve the problem by placing the fuse within the housing or behind a cover plate of an electrical device, thereby requiring one to open the case or remove the cover plate to access the fuse. In this manner, the potential for accidental contact with the fuse is virtually eliminated. Additionally, since fuse access will typically require the removal of one or more screws or other fasteners, an individual would be more likely to deactivate the electrical device prior to intentionally accessing the fuse. However, the cost of this extra security is the added inconvenience of having to partially dismantle the electrical device in order to remove or replace the fuse. This process can be time consuming and tedious, particularly when the removal of screws or other fasteners is required. Some individuals may find such a procedure unacceptable, particularly with respect to electrical devices that require frequent fuse inspections and/or replacements. Furthermore, while concealing a fuse may reduce the likelihood of injury, such a fuse may still be accessed while connected to an energized circuit, and therefore the potential for injury remains.

It is with regard to this background information that the improvements available from the present invention have evolved.

OBJECTS AND SUMMARY OF THE INVENTION

It is the principal object of the present invention to provide an improved holder for cartridge fuses.

Another object of the present invention is to provide an improved fuse holder of the foregoing type which may be used to quickly and easily mount, retain and remove a cartridge fuse in an electrical device.

A further object of the present invention is to provide an improved fuse holder which prevents an individual from contacting a fuse when the fuse is connected to an energized electrical circuit in an electrical device.

A further object of the present invention is to provide an improved fuse holder which is always connected to its associated electrical device to prevent the fuse holder from becoming lost.

Another object of the present invention is to provide an improved method of mounting, retaining and removing a fuse in an electrical device.

In accordance with these and other objects, the present invention is embodied in a fuse holder for retaining and removably connecting a cartridge fuse having an elongated body and electrical contacts at each end to fuse clips located within a housing of an electrical device. The fuse holder includes a fuse drawer and a guide within the housing for slidably retaining the fuse drawer. The fuse drawer has an open top to hold the cartridge fuse. Openings in a rear wall of the fuse drawer are adapted to receive the fuse clips. The fuse is loaded into the drawer through the open top so that the electrical contacts of the fuse are positioned adjacent the openings in the rear wall. The guide within the housing of the electrical device facilitates sliding the fuse drawer between an open position withdrawn from the housing which exposes the open top of the fuse drawer and a closed position within the housing where the open top of the drawer is not exposed. The fuse drawer is inserted within the guide so that the rear wall faces the fuse clips within the housing. Closing the fuse drawer within the housing allows the fuse clips to extend through the openings in the rear wall and engage the electrical contacts of the fuse within the drawer.

A handle on the front wall of the fuse drawer facilitates moving the fuse drawer between the closed position where the fuse clips engage and hold the electrical contacts, and the open position where a fuse may be removed, inspected or loaded within the drawer. Slots formed within the guide preferably mate with guide tabs on the fuse drawer to prevent the fuse drawer from becoming detached from the electrical device when the drawer is opened. Furthermore, an access port is preferably formed in the fuse drawer opposite the open top to facilitate the removal of the fuse. When the fuse drawer is opened, an object may be inserted through the access port to dislodge the fuse from the drawer, thereby allowing for its easy removal.

Contact with the fuse is not possible when the fuse drawer is closed within the housing. Similarly, the electrical contacts are disengaged from the fuse clips and the electrical circuit is broken when the fuse drawer is opened. Thus, it is not possible for an individual to contact the fuse while the fuse is connected to the electrical circuit. Furthermore, the fuse drawer and guide are preferably formed from a nonconducting material such as plastic, thereby preventing accidental electrical shocks due to contact with the fuse drawer or the housing. The fuse holder of the present invention thus allows a cartridge fuse to be safely and simply inspected, connected to, and removed from an electrical device.

A more complete appreciation of the present invention and its scope can be obtained from understanding the accompanying drawings, which are briefly summarized below, the following detailed description of a presently preferred embodiment of the invention, and the appended claims.

DESCRIPTION OF THE PREFERRED EMBODIMENT

Figure 1:
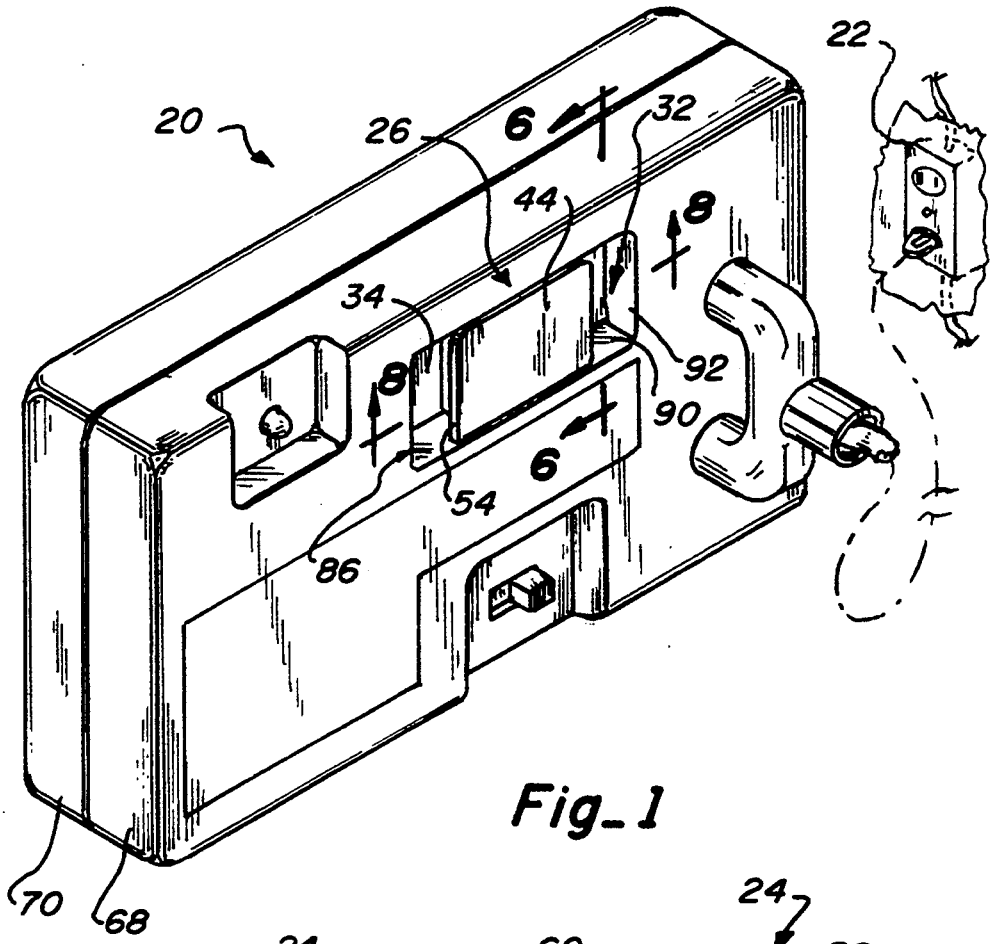
FIG. 1 is a perspective view of an electrical device embodying a fuse holder of the present invention.
Figure 6:
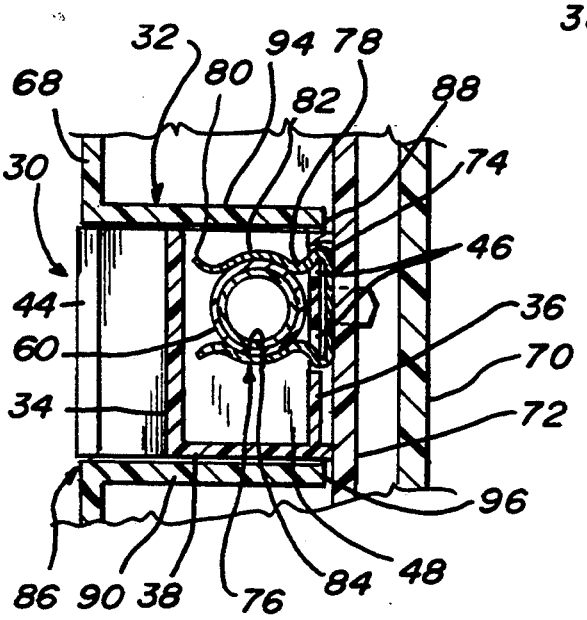
FIG. 6 is an enlarged section view taken substantially in the plane of line 6—6 on FIG. 1.
Figure 7:
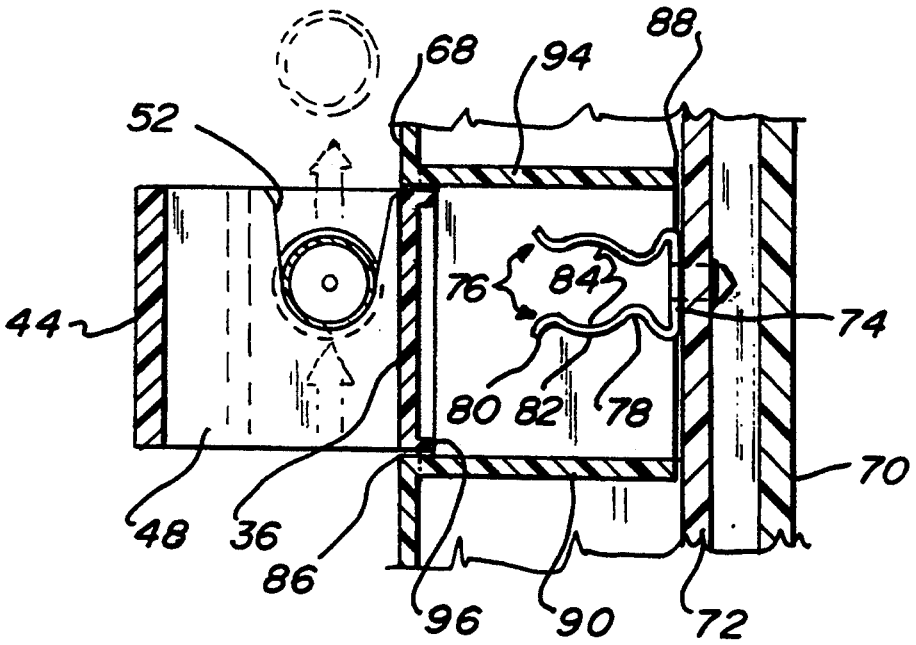
FIG. 7 is an enlarged section view taken substantially in the plane of line 7—7 on FIG. 2.
Figure 8:
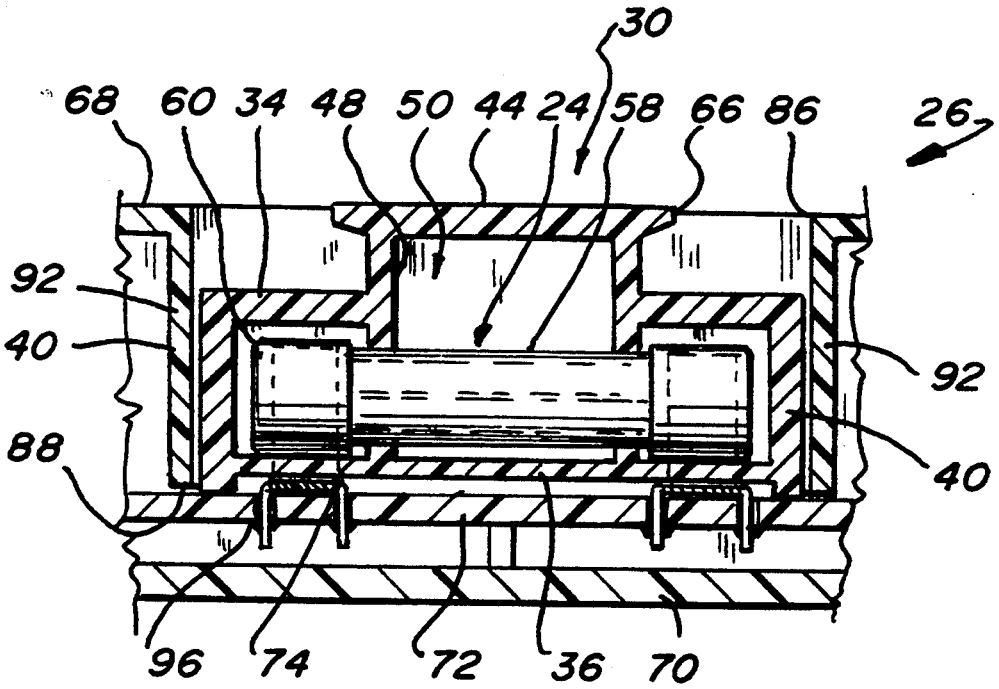
FIG. 8 is an enlarged section view taken substantially in the plane of line 8—8 on FIG. 1.

An electrical device 20 is shown in FIG. 1 connected to a source of alternating current such as an outlet box 22. To protect the electrical device 20 from accidental overloads, a cartridge fuse 24 (FIG. 2) is connected to the electrical circuit within the electrical device 20. The present invention is embodied in a fuse holder 26 which connects the cartridge fuse 24 to spring-type fuse clips 28 (FIG. 4) within the electrical device 20. The fuse holder 26 comprises a fuse drawer 30 which holds the cartridge fuse 24, and a guide 32 connected to the electrical device 20, as shown in FIG. 4. The guide 32 facilitates sliding the fuse drawer 30 between an open position withdrawn from the electrical device 20 (FIGS. 2, 3 and 7) and a closed position within the electrical device 20 wherein the cartridge fuse 24 is connected to the fuse clips 28 (FIGS. 1, 6 and 8).

Figure 2:
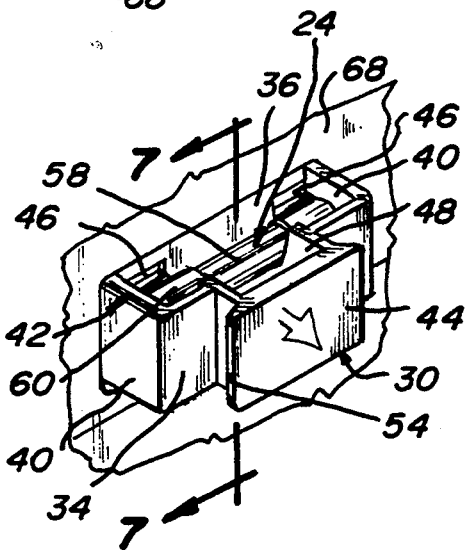
FIG. 2 is a perspective view of the fuse holder illustrated in FIG. 1, showing a fuse drawer in an open position and a cartridge fuse contained therein.
Figure 3:
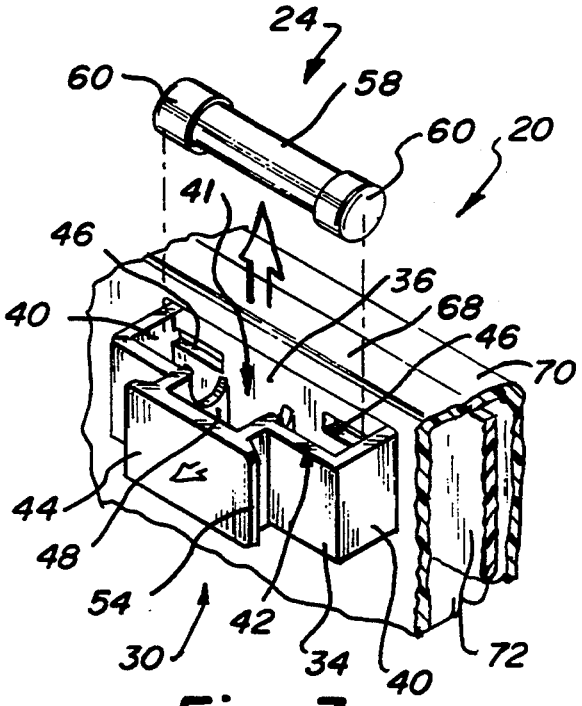
FIG. 3 is another perspective view of the fuse drawer illustrated in FIG. 2, showing the cartridge fuse removed from the fuse drawer, with a portion of the electrical device broken away for clarity.
Figure 4:
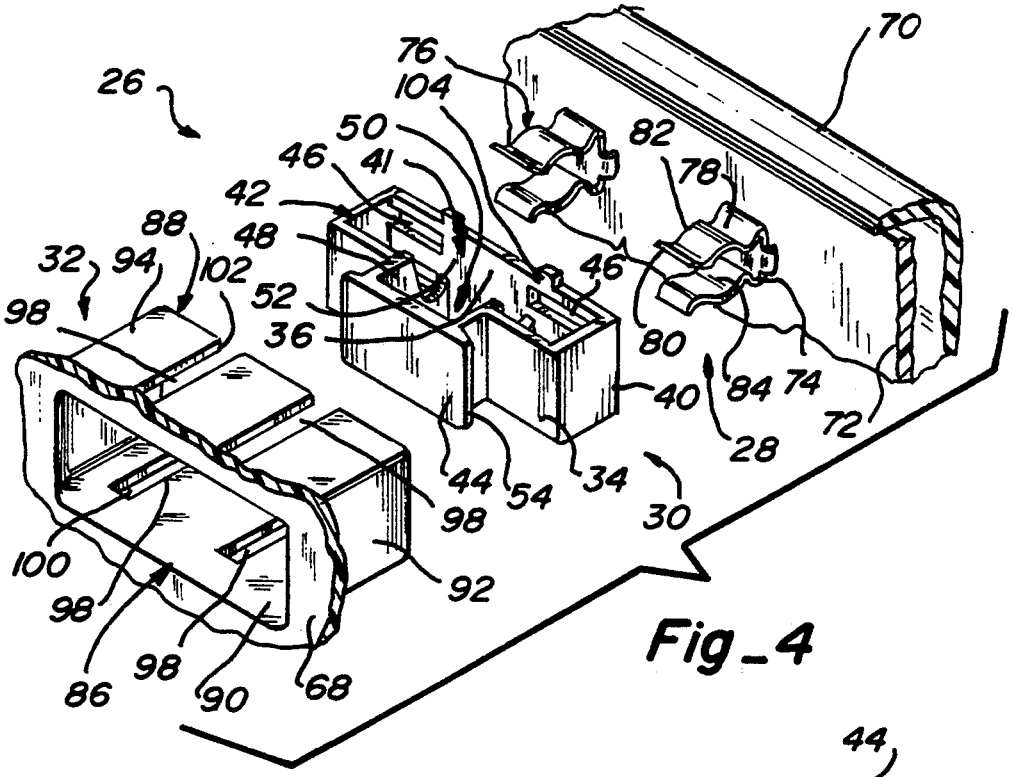
FIG. 4 is an exploded perspective view of the fuse holder illustrated in FIGS. 1–3 and also showing a guide and a pair of fuse clips mounted on a circuit board of the electrical device.

The fuse drawer 30 is formed by a front wall 34, a rear wall 36 parallel to the front wall 34, a bottom wall 38 perpendicular to and connecting the front and rear walls 34 and 36, and two opposing end walls 40 as shown in FIGS. 2–5. The fuse drawer 30 has a length dimension defined by the distance between the opposing end walls 40. The walls 34, 36, 38 and 40 combine to form an interior volume 41 having an open top 42 opposite the bottom wall 38. The interior volume 41 is preferably rectangular and of sufficient size to accommodate the cartridge fuse 24 therein, as shown in FIG. 3. An elongated handle 44 of shorter length than the length of the fuse drawer 30 is preferably attached to and centered lengthwise on the front wall 34 (FIGS. 2–5). Elongated openings 46 are formed in the rear wall 36 adjacent each end wall 40, as shown in FIGS. 2–4. The openings 46 are adapted to receive the fuse clips 28 and allow the fuse clips to contact the cartridge fuse 24 when the fuse drawer 30 is closed within the electrical device 20 (FIG. 6).

Within the interior volume 41 of the fuse drawer 30, two curved supports 48 preferably extend between the front and rear walls 34 and 36 at separate locations along the length of the fuse drawer, as shown in FIGS. 4–7. The curved supports 48 are parallel to one another and are each fixed to the bottom wall 38 of the fuse drawer 30 so that a middle section 50 is formed therebetween within the interior volume 41 of the drawer 30. Each curved support 48 extends away from the bottom wall 38 and forms a concave face 52 that is directed upward toward the open top 42 of the fuse drawer 30. The concave face 52 has a radius of curvature substantially equal to the radius of curvature of the cylindrical body 58 of the cartridge fuse 24. Thus, the curved supports 48 provide a seat for holding the cartridge fuse 24 once the fuse is loaded within the fuse drawer 30.

The two curved supports 48 attach the elongated handle 44 to the front wall 34 of the fuse drawer 30 as shown in FIGS. 2–5. The middle section 50 is thus bounded by the handle 44 and the rear wall 36, in addition to the curved supports 48. The curved supports 48 preferably position the elongated handle 44 slightly forward of the front wall 34 of the fuse drawer 30 as shown in FIGS. 2–5. End portions of the elongated handle 44 extend beyond the curved supports 48 to form flanges 54 which allow one to more easily grip the handle when the fuse drawer 30 is closed within the electrical device 20.

The cartridge fuse 24 comprises an elongated cylindrical body 58 with electrical contacts 60 at each end (FIGS. 3 and 8). The elongated cartridge fuse 24 is loaded into the top 42 of the fuse drawer 30 while the drawer is withdrawn from the electrical device 20. The length of the cartridge fuse 24 is slightly less than the length of the fuse drawer 30 to allow the fuse to be easily loaded within the open top 42 of the fuse drawer with the electrical contacts 60 adjacent the respective end walls 40. The concave faces 52 engage the elongated body 58 of the fuse 24 and position the electrical contacts 60 in front of the openings 46 in the rear wall 36 of the fuse drawer 30 as shown in FIGS. 2 and 6.

Figure 5:
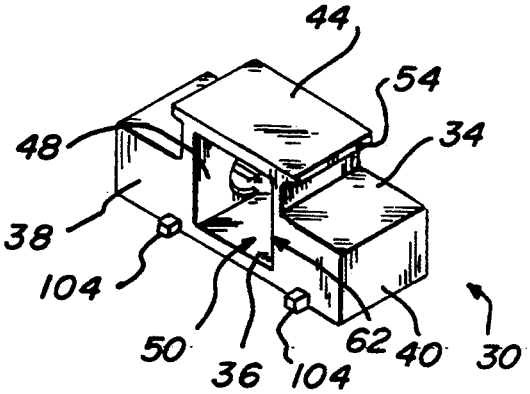
FIG. 5 is another perspective view of the fuse drawer shown in FIGS. 2–4.

Due to the close fit of the cartridge fuse 24 within the interior volume of the fuse drawer 30, an access port 62 is preferably formed in the bottom wall 38 of the fuse drawer to enhance removal of the fuse from the drawer. The access port 62 preferably comprises a rectangular hole that extends between the curved supports 48 along the length of the bottom wall 38, as shown in FIG. 5. When the fuse drawer 30 is open, an elongated object, such as a finger or a pen, may be inserted through the access port 62 and into the middle section 50 to dislodge the elongated body 58 of the cartridge fuse 24 from its seated position between the curved supports 48 so that the fuse can be removed from the open top 42 of the fuse drawer 30.

Although the present invention may be utilized with a variety of electrical devices, the electrical device 20 shown in FIG. 1 comprises a forward housing 68 and a rearward housing 70 connected together by screws or other types of fasteners. A circuit board 72 which holds the spring-type fuse clips 28 is preferably attached to the rearward housing 70 as shown in FIGS. 3 and 4. The spring-type fuse clips 28 comprise a base portion 74 fixed to the circuit board 72 and two parallel tongs 76 having a rearward end 78 connected to the base portion 74 and a rounded forward end 80 that extends toward the forward housing 68, as shown in FIGS. 4, 6 and 7. A middle portion 82 between the rearward and forward ends 78 and 80 of each tong 76 is curved to form a concave seat 84 for the electrical contacts 60 of the cartridge fuse 24. The concave seats 84 of the parallel tongs face one another and are separated by a distance substantially equal to the diameter of the electrical contacts 60. The operation of the spring-type fuse clips 28 is well known in the art, and will be discussed in greater detail below.

The guide 32 is preferably integrated with the forward housing 68 and has a first open end 86 that is flush with the exterior of the forward housing, as shown in FIG. 4. A second open end 88 of the guide 32 lies adjacent the circuit board 72 when the forward and rearward housings 68 and 70 of the electrical device 20 are joined, as shown in FIGS. 6–8. Alternatively, a separate guide could be mated with a separate opening in the forward housing 68, rather than the integral construction shown.

The guide 32 is preferably rectangular in cross-section (with curved corners), having a bottom wall 90 and opposing end walls 92 that parallel the respective walls 38 and 40 of the fuse drawer 30, in addition to a top wall 94 that corresponds to the open top 42 of the fuse drawer. When the forward and rearward housings 68 and 70 are joined, the guide surrounds the fuse clips 28 attached to the circuit board 72, as shown in FIGS. 4 and 6–8.

The cross-sectional shape of the guide 32 has substantially the same configuration (with slightly larger dimensions) as the periphery of the rear wall 36 of the fuse drawer 30, thus allowing the rear wall to slide easily between the first and second open ends 86 and 88 of the guide. Upon approaching the second open end 88 of the guide, the openings 46 in the rear wall 36 pass over the tongs 76 of the fuse clips 28. The openings 46 preferably comprise a pair of rectangular holes formed parallel one another adjacent each end wall 40 as shown in FIGS. 2–4. Each rectangular hole is adapted to receive one of the two tongs 76 of a fuse clip 28 as shown in FIG. 6. While rectangular holes are preferred, different shaped holes could be used to form the openings 46. Alternatively, one large opening could be positioned adjacent each end wall 40 instead of a pair of rectangular holes, provided the opening is large enough to receive both tongs 76 of a fuse clip 28.

When the fuse drawer 30 is closed within the electrical device 20, the tongs 76 of the fuse clips 28 extend through the openings 46 as shown in FIGS. 6 and 8. However, the base portions 74 of the fuse clips 28 extend slightly forward of the circuit board 72 as shown in FIGS. 4 and 6–8. Thus, to provide sufficient clearance for the base portions 74, and to prevent contact between the rear wall 36 of the fuse drawer 30 and the fuse clips 28, a small flange 96 surrounds the periphery of the rear wall 36, as shown in FIGS. 6 and 8. The flange 96 extends to the rear of the rear wall 36 and contacts the circuit board 72 when the fuse drawer 30 is closed. Additionally, the distance between the flange 96 and the handle 44 of the fuse drawer 30 is substantially equal to the distance between the first and second open ends 86 and 88 of the guide 32. Thus, closure of the fuse drawer 30 positions the handle 44 substantially flush with the first open end 86 of the guide 32, as shown in FIGS. 1, 6 and 8.

The guide 32 further includes a pair of elongated slots 98 within both its bottom and top walls 90 and 94, as shown in FIG. 4. The slots 98 run from a closed first end 100 adjacent the first open end 86 of the guide and an open second end 102 at the second open end 88 of the guide. Corresponding pairs of guide tabs 104 are attached to the top and bottom of the fuse drawer 30 adjacent the rear wall 36 as shown in FIGS. 4 and 5. The guide tabs 104 are initially fit within the open second end 102 of the slots 98 when the fuse drawer 30 is positioned within the second open end 88 of the guide 32 prior to the joinder of the forward and rearward housings 68 and 70.

To ensure the bottom wall 38 is properly oriented within the guide 32, the slots 98 on the top wall 94 of the guide (and the corresponding guide tabs 104 on the open top 42 of the fuse drawer) are spaced more closely together than the slots on the bottom wall 90 of the guide (and the corresponding guide tabs 104 on the bottom wall 38 of the fuse drawer). Once the fuse drawer 30 is positioned within the guide 32 and the forward and rearward housings 68 and 70 are joined together, the guide tabs 104 are constrained to move within the slots 98 and thereby enhance the sliding movement of the fuse drawer within the guide. When the fuse drawer 30 is opened, the guide tabs 104 abut the closed first end 100 of the slots 98 adjacent the first open end 86 of the guide 32 to prevent the fuse drawer from becoming completely detached from the electrical device 20.

The fuse holder 26 makes mounting, retaining and removing a cartridge fuse in an electrical device 20 a relatively simple operation. First, the fuse drawer 30 is opened so that a cartridge fuse 24 may be loaded within the interior volume. The guide tabs 104 within the slots 98 prevent the fuse drawer 30 from being pulled completely out of the guide 32. Once the elongated body 58 of the cartridge fuse 24 is placed securely on the concave faces 52 of the curved supports 48, the fuse drawer 30 is closed by preferably pushing on the handle 44. As the fuse drawer 30 is inserted within the guide 32, the rounded forward ends 80 of the tongs 76 extend through the openings 46 in the rear wall 36 and contact the electrical contacts 60 of the cartridge fuse 24. The force applied to the cartridge fuse 24 through the handle 44 and the curved supports 48 tends to separate the rounded forward ends 80 of the two tongs 76. Once the forward ends 80 of the tongs 76 are separated by a distance substantially equal to the diameter of the electrical contacts 60, the force applied to the handle tends to push the electrical contacts 60 past the forward ends of the tongs. The concave seats 84 on the middle portions 82 of the tongs 76 then close about the electrical contacts 60 and hold the contacts 60 firmly therebetween. Contact between the rear wall 36 of the fuse drawer 30 and the electrical contacts 60 maintain the drawer in the closed position while the tongs 76 hold the electrical contacts 60.

In the closed position, contact between the electrical contacts 60 of the cartridge fuse 24 and the tongs 76 of the fuse clips 28 closes the electrical circuit within the electrical device 20. The fuse drawer 30 can be subsequently opened, and the electrical circuit broken, by pulling on the handle 44 with sufficient force to again separate the rounded forward ends 80 of the tongs 76 and thus allow the cartridge fuse 24 to disengage from the fuse clips 28. The pulling force applied to the handle 44 is transferred to the fuse by the rear wall 36 of the fuse drawer 30.

Once the fuse is disengaged from the fuse clips 28 as the drawer 30 is opened, the cartridge fuse 24 may be inspected or removed from the drawer. Removal of the cartridge fuse 24 is preferably accomplished by inserting an elongated object through the access port 62 in the bottom wall 38 to dislodge the elongated body 58 of the fuse from the grip of the curved supports 48.

The fuse holder 26 of the present invention provides a number of improvements with respect to both safety and convenience. In the open position, the cartridge fuse 24 within the fuse drawer 30 may be easily inspected or replaced with no danger of electrical shock since the fuse is not connected to the fuse clips 28. Similarly, there is no possibility of contacting the fuse while it is connected to the fuse clips 28 because the fuse is hidden within the electrical device 20 when the fuse drawer 30 is closed. Furthermore, both the fuse drawer 30 and the guide 32 are formed from a nonconducting material, preferably plastic, to prevent accidental shocks which might otherwise result from contact with the handle 44 or the forward housing 68 when the drawer 30 is closed.

In addition to the above-noted safety features, the fuse holder 26 includes other features which enhance its use. First, opening and closing the fuse drawer 30 does not require the removal of fasteners such as screws. Moreover, the handle 44 of the fuse drawer 30 is centered lengthwise within the guide 32 and is substantially flush with the outer surface of the forward housing 68 when the fuse drawer 30 is closed. The flush mounting of the handle 44 protects the fuse drawer from damage during operation of the electrical device 20 and helps to prevent objects from accidentally catching on the handle and opening the fuse drawer unintentionally. Additionally, centering the handle 44 within the longer guide 32 allows an individual to easily grip the handle by inserting a thumb and a finger behind the flanges 54 on the opposite ends of the handle. Furthermore, the guide tabs 104 on the fuse drawer 30 keep the drawer tethered to the guide 32 and thus keep the drawer from being lost.

A presently preferred embodiment of the present invention and many of its improvements have been described with a degree of particularity. This description has been made by way of preferred example and is based on a present understanding of knowledge available regarding the invention. It should be understood, however, that the scope of the present invention is defined by following claims, and not necessarily by the detailed description of the preferred embodiment.

The invention claimed is:

1. A fuse holder for removably retaining and electrically connecting a fuse in a housing of an electrical device, said fuse having electrical contacts, the housing having fuse clips for electrically and mechanically connecting to the fuse electrical contacts, said fuse holder comprising:

a fuse drawer having an interior volume, a top opening into the interior volume, and a support within the interior volume for receiving the fuse;

a guide attached to said housing and receiving said fuse drawer for slidable movement between a closed position in which the interior volume is positioned interiorly within said housing and an open position in which the interior volume is positioned substantially exteriorly of the said housing;

said fuse drawer defining openings positioned to allow said fuse clips to extend into said interior volume and engage said electrical contacts of a fuse positioned within the interior volume when said fuse drawer is in the closed position; and said fuse drawer moving the electrical contacts of a fuse positioned within the interior volume to a position in which said fuse clips disengage from said electrical contacts when the fuse drawer is moved to the open position.

2. A fuse holder as defined in claim 1, wherein said support places the electrical contacts of a fuse positioned within the interior volume out of engagement with the fuse clips when the fuse is exposed at the exterior of said housing.

3. A fuse holder as defined in claim 1, wherein the engagement of the fuse clips with the electrical contacts of a fuse within the interior volume is operative to assist in holding the fuse drawer in the closed position.

4. A fuse holder as defined in claim 1, wherein said fuse drawer includes a guide tab, and wherein said guide defines an elongated slot for slidably retaining said guide tab and for preventing said fuse drawer from becoming detached from said guide when said fuse drawer is opened.

5. A fuse holder for removably retaining and electrically connecting a fuse in a housing of an electrical device, said fuse having electrical contacts, the housing having fuse clips for electrically and mechanically connecting to the fuse electrical contacts, said fuse holder comprising:

a fuse drawer having a front wall, a rear wall opposite said front wall, a bottom wall connecting said front and rear walls, and opposing end walls, said walls defining an interior volume having an open top for receiving said fuse, said fuse drawer having a length defined by the distance between said opposing end walls;

a guide attached to said housing and extending into said housing to facilitate sliding said fuse drawer between an open position withdrawn from said housing and a closed position within said housing, said guide aligning with said fuse clips within said housing to direct said rear wall of said fuse drawer toward said fuse clips;

said rear wall of said fuse drawer defining openings adapted to receive said fuse clips and allow said fuse clips to extend into said interior volume and engage said electrical contacts of a fuse positioned within the interior volume when said fuse drawer is in the closed position; and said fuse drawer locating the electrical contacts of a fuse positioned within the interior volume to a position in which said fuse clips disengage from said electrical contacts when the fuse drawer is moved to the open position.

6. A fuse holder as defined in claim 5, wherein the engagement of the fuse clips with the electrical contacts of a fuse within the interior volume is operative to assist in holding the fuse drawer in the closed position.

7. A fuse holder as defined in claim 5, further including an elongated handle attached to said front wall for moving said fuse drawer between said open and closed positions.

8. A fuse holder as defined in claim 7, wherein said handle has a length dimension defined by two opposing ends, said length dimension being smaller than the length of said fuse drawer.

9. A fuse holder as defined in claim 8, wherein said handle is substantially flush with an exterior surface of said housing when said fuse drawer is closed, said opposing ends defining flanges to allow an individual to grip said handle when said fuse drawer is closed.

10. A fuse holder as defined in claim 5, wherein said bottom wall defines an access port to allow an object to be inserted within the interior volume and dislodge a fuse positioned within the interior volume toward said open top when said fuse drawer is opened.

11. A fuse holder as defined in claim 10, wherein said fuse drawer further includes two curved supports extending between said front and rear walls along said bottom wall and defining a middle section therebetween within said interior volume, said curved supports having a concave face directed toward said open top to provide a seat for receiving a fuse and positioning the electrical contacts of said fuse between said openings.

12. A fuse holder as defined in claim 11, wherein said curved supports place the electrical contacts of a fuse positioned within the interior volume out of engagement with the fuse clips when the fuse is exposed at the exterior of the housing.

13. A fuse holder as defined in claim 12, wherein said access port extends between said two curved supports to allow access to said middle section when said fuse drawer is opened.

14. A fuse holder as defined in claim 5, wherein said fuse drawer further includes a guide tab attached adjacent said rear wall, and wherein said guide defines an elongated slot for slidably retaining said guide tab as said fuse drawer moves between said open and said closed positions and for preventing said rear wall from becoming detached from said guide when said fuse drawer is opened.

15. A fuse holder for retaining and removably connecting a fuse to fuse clips located within a housing of an electrical device, said fuse having an elongated body and electrical contacts spaced along the body adapted for engagement with said fuse clips, said fuse holder comprising:

a fuse drawer having a front wall, a rear wall opposite said front wall, a bottom wall connecting said front and rear walls, and opposing end walls, said walls defining an interior volume having an open top for receiving said fuse, said fuse drawer having a length defined as the distance between said opposing end walls;

a guide attached to said housing and extending into said housing to facilitate sliding said fuse drawer between a closed position within said housing and an open position withdrawn from said housing, said guide aligning with said fuse clips within said housing to direct said rear wall of said fuse drawer toward said fuse clips;

said rear wall of said fuse drawer defining openings adapted to receive said fuse clips and allow said fuse clips to extend into said interior volume and engage said electrical contacts of a fuse positioned within the interior volume when said fuse drawer is in the closed position;

said fuse drawer locating the electrical contacts of a fuse positioned within the interior volume to a position in which said fuse clips disengage from said electrical contacts when the fuse drawer is moved to the open position;

said fuse drawer further including an elongated handle attached to said front wall for moving said fuse drawer between said open and closed positions, said handle having a length dimension defined by two opposing ends, said length dimension being smaller than the length of said fuse drawer, and said handle being substantially flush with an exterior surface of said housing when said fuse drawer is closed, and said handle defining flanges at said opposing ends to allow an individual to grip said handle when said fuse drawer is closed;

said fuse drawer further including curved supports extending between said front and rear walls along said bottom wall within said interior volume, said curved supports having a concave face directed toward said open top to provide a seat for receiving a fuse and positioning the electrical contacts of said fuse between said openings;

said bottom wall defining an access port to allow an object to be inserted within the interior volume and dislodge a fuse positioned on said curved supports toward said open top when said fuse drawer is opened;

said fuse drawer further including a guide tab attached adjacent said rear wall; and said guide defining an elongated slot for slidably retaining said guide tab as said fuse drawer moves between said open and said closed positions and for preventing said rear wall from becoming detached from said guide when said fuse drawer is opened.

* * * * *